United States Patent [19]

Roberts

[11] 4,271,539

[45] Jun. 9, 1981

[54] QUICK-CHANGE TOILET SYSTEM

[75] Inventor: George C. Roberts, Los Angeles, Calif.

[73] Assignee: Inca-One Corporation, Los Angeles, Calif.

[21] Appl. No.: 16,551

[22] Filed: Mar. 1, 1979

[51] Int. Cl.[3] ..... E03D 1/00; E03D 5/016; E05D 7/10; B65D 43/12

[52] U.S. Cl. ..... 4/300; 4/236; 4/318; 4/321; 16/176; 220/326; 220/346

[58] Field of Search ..... 4/234–240, 4/317–323, 420, 162, 533, 300, 329, 459, 476, 479, 483; 16/149, 171, 176, 181; 220/326, 346, 347

[56] References Cited

U.S. PATENT DOCUMENTS

| | | | |
|---|---|---|---|
| 532,908 | 1/1895 | Ricketts | 4/236 |
| 2,448,330 | 8/1948 | Sperzel | 4/236 |
| 2,450,209 | 9/1948 | Sperzel | 4/236 |
| 2,852,786 | 9/1958 | Reinhard | 4/236 |
| 3,042,933 | 7/1962 | Garver | 4/317 |
| 3,471,874 | 10/1969 | Dixon | 16/149 X |
| 3,545,011 | 12/1970 | Helke et al. | 4/317 |
| 3,670,441 | 6/1972 | Blount | 4/236 |

FOREIGN PATENT DOCUMENTS

| | | | |
|---|---|---|---|
| 1096837 | 1/1961 | Fed. Rep. of Germany | 4/317 |

*Primary Examiner*—Stuart S. Levy
*Attorney, Agent, or Firm*—Blakely, Sokoloff, Taylor & Zafman

[57] ABSTRACT

A quick-change toilet system capable of being readily converted between a non-flushing toilet and a recirculating flushing toilet is disclosed. The system includes a waste holding tank with an open frame member mounted on the top thereof. The system utilizes a non-flushing toilet cover and a flushing type toilet cover, both of which have a similar locking pin arrangement which permits either type of cover to be removably secured to a locking bar permanently affixed to the frame member. The non-flushing toilet cover includes an opening having a conventional toilet seat and toilet seat cover disposed thereover. The flushing toilet cover, which is of the recirculating variety, is similar to the non-flushing cover but additionally includes a toilet bowl having a flushing fluid outlet. A manually operated pump draws flushing fluid from the waste holding tank through a filter and delivers a quantity of filtered flushing fluid to the toilet bowl for flushing purposes through the flushing fluid outlet. The system permits the non-flushing and flushing cover, including the pump and associated filter, to be readily interchanged thereby enabling one to convert between a flushing and a non-flushing toilet without the use of tools.

8 Claims, 11 Drawing Figures

QUICK-CHANGE TOILET SYSTEM

BACKGROUND OF THE INVENTION

1. Field of the Invention

The invention disclosed herein relates to the field of portable toilets and more particularly to a portable toilet system convertible between a non-flushing toilet and a recirculating flushing toilet.

2. Background of the Invention

There are currently in use two types of portable toilets including toilets of the non-flushing and flushing variety. Such toilets are commonly installed in small portable shelters or cabanas which are rented to construction companies and the like when conventional sanitation facilities are not available. Generally speaking, non-flushing, i.e., static, toilets are used in construction sites and other similar applications where more primitive sanitation facilities are found to be acceptable. There are, however, many applications wherein flushing-type toilets such as recirculating flush toilets are needed. Such applications typically include special events, parades, and sporting events such as golf opens or track meets.

Heretofore, owner/operators of portable toilet rental companies were required to stock portable toilets of both the non-flushing and flushing variety. If the requirements for flushing toilets exceeded the rental companies capacity, it is currently the practice to purchase flush conversion kits for converting non-flushing toilets to flushing toilets. Such conversions are time consuming and cannot be performed in the field. Furthermore, such conversions are permanent, therefore, once the conversion has been performed, the toilet cannot be reconverted to a non-flushing toilet without great effort.

A toilet flushing system readily convertible between a flushing-type toilet and a non-flushing toilet would be highly desirable. Such a system would greatly reduce the number of toilets required to be stocked by portable toilet rental companies. For example, if a large number of flushing-type toilets were required, non-flushing toilets could be quickly and easily converted to flushing toilets. Conversely, if non-flushing toilets were needed, available flushing toilets could be converted. The convertible toilet system should be easily converted, either at the rental facility or in the field, without the use of tools and without the necessity of pumping out the toilet. Such a system would have the further advantage that it would facilitate the inspection of the various components which make up the system and enable one to replace an entire malfunctioning module in the field. The defective module could then be returned to the rental facility where the necessary repairs could be performed. This procedure would be vastly more convenient than effecting repairs in the field as is presently required.

SUMMARY OF THE INVENTION

A quick-change toilet system capable of being readily converted between a non-flushing toilet and a recirculating flushing toilet is disclosed. The system comprises a waste holding tank with an open frame member mounted on the top thereof. A locking bar, which is permanently secured to the frame member, is used for removeably mounting either a flushing-type toilet cover or a non-flushing type cover on the toilet.

The non-flushing cover includes a central opening having a conventional toilet seat and toilet seat cover disposed thereover, both of which are hingedly coupled to the cover. A slot for receiving the locking bar is formed in one edge of the cover with a pair of locking pins being mounted on opposite ends of the slot. Channels are formed in both ends of the locking bar for receiving the cover locking pins. An indentation is formed in the top surface of each channel for entraping the locking pins.

The locking bar is secured to the frame member by a resilient coupling means which forces the bar downward against the upper surface of the frame member. The toilet cover is fastened to the toilet by positioning the edge of the cover next to the locking bar with the locking pins adjacent the locking bar channels. The edge of the cover is forced towards the locking bar with the locking pins tending to force the locking bar upwards away from the frame member. When the bar has been displaced a sufficient distance from the frame member, the locking pins are free to enter the locking bar channels and engage the indentations located therein. Once the locking pins engage the indentations, the locking bar is free to be forced back by the resilient coupling means to a normal position adjacent the frame member thereby locking the pins in place. When the pins are locked in place, the locking bar and pin combination acts as a hinge which permits the cover to be pivoted about the locking pins. The cover can, therefore, be raised from one end thereby opening the holding tank either for inspection purposes or for the purpose of pumping out the collected waste.

A latch comprising two complementary fabric fastening strips such as sold under the trademark Velcro is used for latching the cover in place. The first strip is secured to the bottom surface of the cover at the edge opposite the locking pins with the second strip being secured to the frame member such that the first strip will contact the second strip when the cover is closed. The hooks and loops of the respective strips engage one another thereby securing the cover in a closed position.

Removal of the toilet cover is accomplished by gripping the cover edge adjacent the fastening strips and pulling upwards thereby causing the fastening strips to separate and the cover to unlatch. The cover is then pulled away from the locking bar so that the resultant force exerted by the locking pins on the forward edge of the indentations in the locking bar tends to force the bar upward in opposition to the resilient coupling means. When the locking bar is lifted a sufficient distance, the locking pins may then escape the indentations and exit the locking bar channels thereby freeing the cover from the toilet system.

The recirculating flushing toilet cover is substantially identical to the non-flushing cover but further includes a toilet bowl positioned in the cover opening. A manually operated pump draws up a recirculating flushing fluid from the waste holding tank through a filter resting on the bottom of the tank and delivers the fluid to the toilet bowl for flushing purposes. The flushing toilet cover has a locking pin arrangement similar to the arrangement on the non-flushing toilet cover. It can be seen, therefore, that the flushing and non-flushing covers are interchangeable, thereby permitting a toilet to be easily converted between a flushing and a non-flushing type toilet without the use of tools.

DETAILED DESCRIPTION OF THE INVENTION

Figure 1:
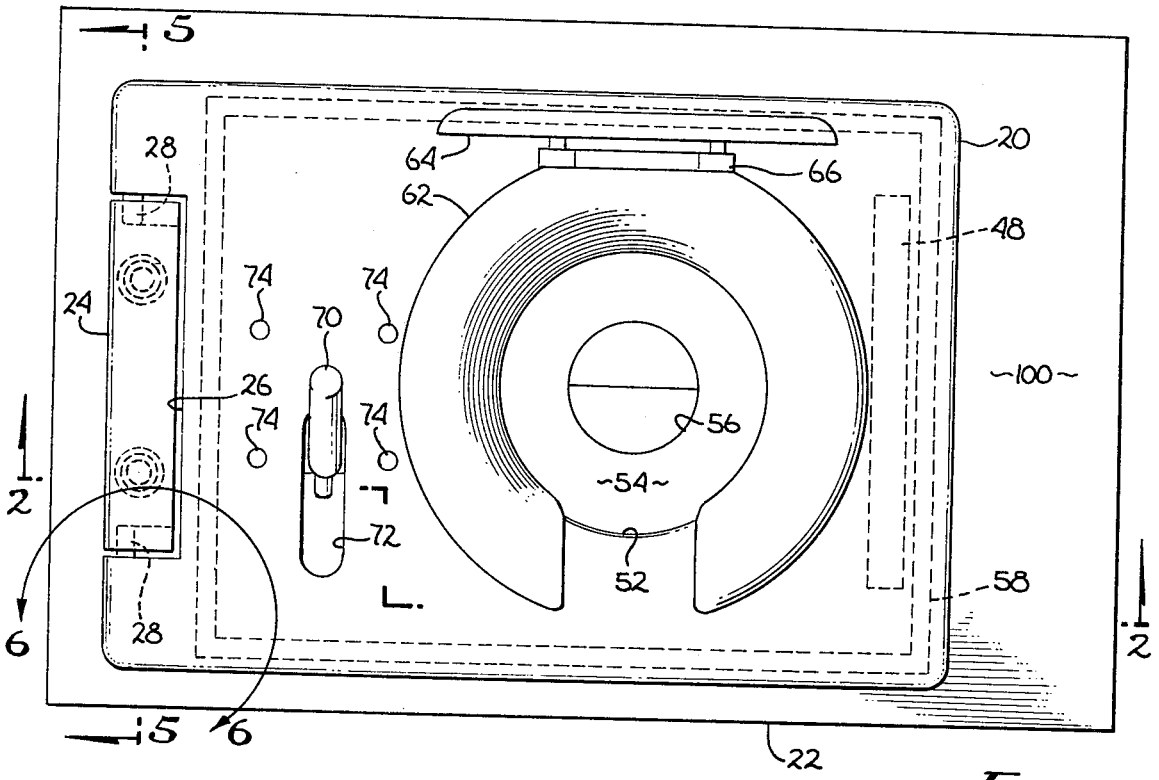
FIG. 1 is a plan view of a first embodiment of the invention.
Figure 2:
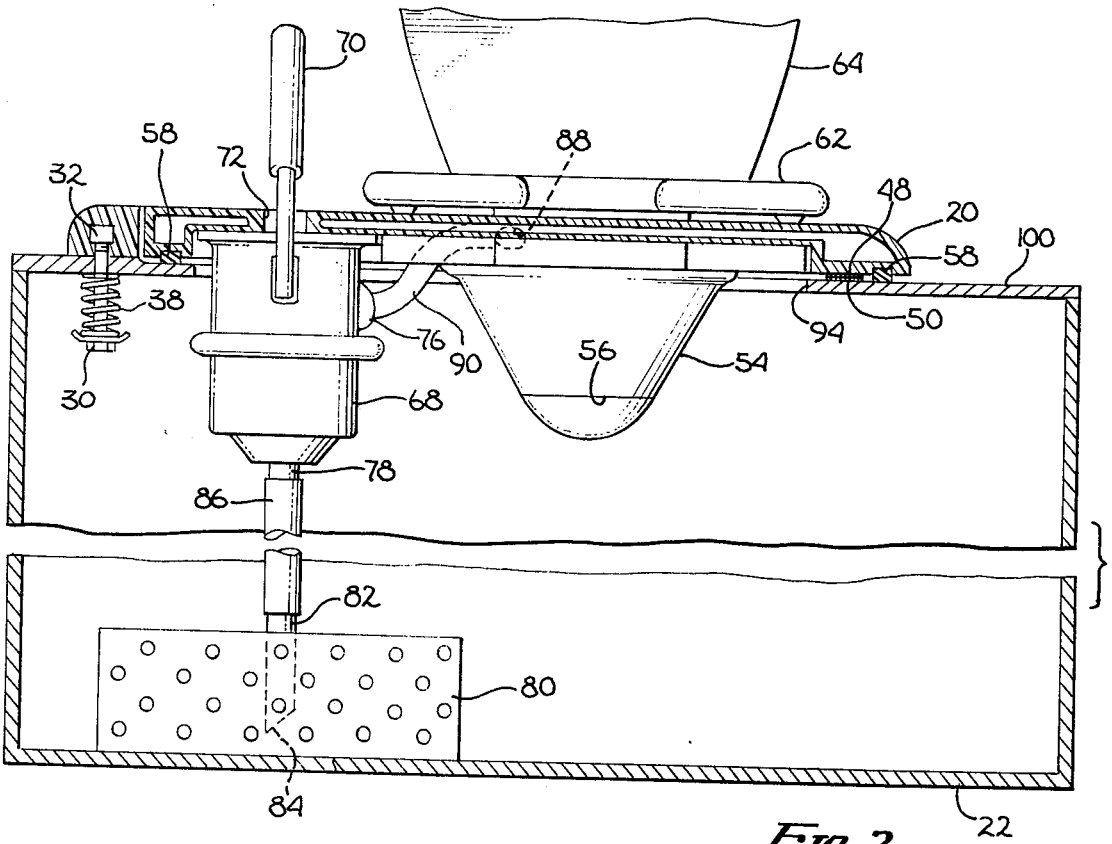
FIG. 2 is a cross-sectional view of the invention taken substantially through section line 2—2 of FIG. 1.

Referring to the drawings, a first embodiment of the invention may be seen in FIGS. 1, 2, 4, 5, 6 and 7. The first embodiment is a recirculating toilet which includes a removeable toilet cover 20 disposed over a waste holding tank 22. Cover 20 is secured to the holding tank 22 by way of a frame member 100 which is fastened to the upper portion of the tank. Frame member 100 is provided with a large opening 94. Cover 20 is a substantially rectangular shaped member, preferably made of molded polyethylene. As can best be seen in FIG. 4, cover 20 is hollow so as to reduce the weight of the cover and the cost of manufacture.

Figure 5:
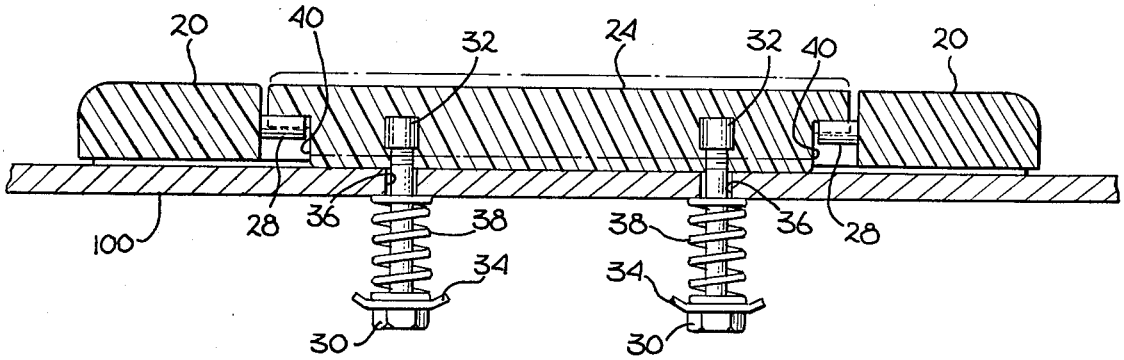
FIG. 5 is a cross-sectional end view of the invention taken substantially through section line 5—5 of FIG. 1 showing some of the details of the locking bar.

A slot 26 is formed in one edge of cover 20 for receiving a locking bar 24. Two inwardly extending locking pins 28, which co-operate with the locking bar, are formed in opposite sides of the slot 26. As shown in FIG. 5, locking bar 24 is permanently affixed to the top surface of frame member 100 by way of a pair of bolts 30. Locking bar 24 includes two spaced-apart openings 32, having threaded metal inserts for receiving bolts 30. Frame member 100 is provided with a pair of openings 36 which are in substantial alignment with threaded openings 32 and somewhat larger in diameter. Bolts 30 extend upwardly through openings 36 into threaded engagement with the locking bar openings 32.

Each bolt 30 is provided with a washer 34 positioned adjacent the head of the bolt. A spring 38 is secured over each bolt between washer 34 and the bottom surface of frame member 100. Springs 38 are normally slightly compressed thereby forcing the locking bar 24 downwardly into firm engagement with the top surface of the frame member.

Figure 6:
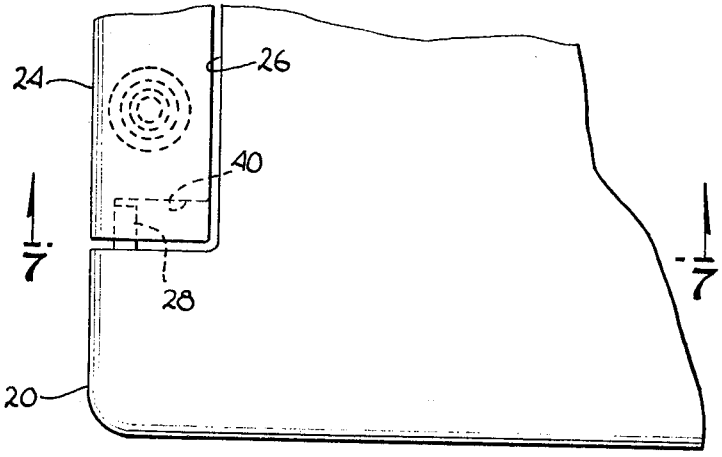
FIG. 6 is an enlarged fragmentary view of the invention taken from FIG. 1 as indicated by line 6—6.

As can best be seen in FIGS. 5 and 6, channels 40 are formed in the bottom of the locking bar 24 at both ends of the bar. Each channel 40 extends beginning from the forward portion of the bar adjacent the removable cover 20 to a point approximately three quarters of the width of the bar. The width of each channel 40 is slightly greater than the length of locking pin 28 so that the locking bar 24 may be positioned in slot 26 of the removable cover with the locking pins positioned within the channels. Each channel further includes an arcuate indentation 42 formed in the upper surface of the channel near the rear which receives and engages the corresponding locking pin 28.

Figure 7:
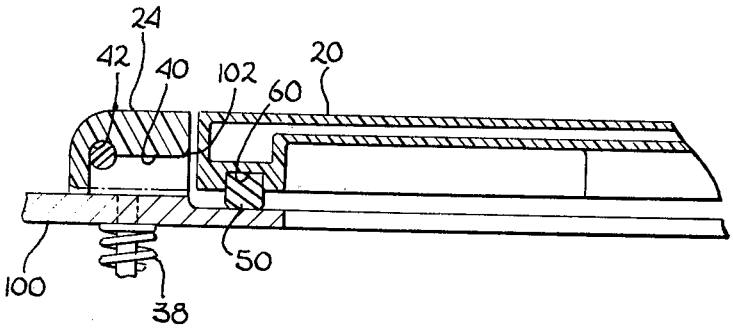
FIG. 7 is a fragmentary cross-sectional view taken substantially through line 7—7 of FIG. 6 showing the cover in the locked position.

When the removable cover 20 is in place as shown, for example, in FIG. 7, indentations 42 grip each of the locking pins 28 thereby restricting lateral movement of the cover. The cover 20 can be lifted by the edge opposite the side coupled to the locking bar 24 and pivoted about pins 28 with the bar and locking pin combination acting as a hinge. This hinging action permits the various components of the toilet to be inspected and/or the waste matter in the tank pumped out without the necessity of removing the cover.

Figure 8:
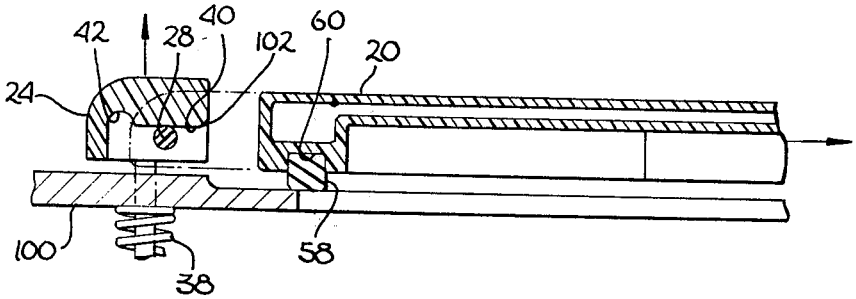
FIG. 8 is a fragmentary cross-sectional view taken substantially through line 7—7 of FIG. 6 showing the cover in the unlocked position.

Cover 20 may be detached from the locking bar 24 by gripping the edge of the cover opposite slot 26 and pulling the cover away from the bar in the direction indicated by the arrow of FIG. 8. The lateral force which pins 28 exert on the forward edge of indentations 42 results in an upwardly directed component of force applied to the locking bar 24 which tends to compress springs 38. When the upward force exerted on the bar is in the range of approximately 25 to 30 pounds, the bar will separate from the frame member 100 thereby permitting the locking pins to exit indentations 42 as shown in FIG. 8. Further lateral movement of the cover will cause the locking pins 28 to exit channels 40 and detach from the locking bar thereby freeing the cover from the remainder of the toilet. Once the cover 20 has been removed, locking bar 24 will return to its normal position adjacent frame member 100.

Cover 20 may be reinstalled by positioning the edge of the cover near the locking bar 24 with the locking pins 28 adjacent the forward portion of the corresponding channel 40. A laterally applied force will cause the rounded locking pins to engage the leading edge of the locking bar immediately above channel 40 thereby exerting an upwardly directed force. Bevels 102 are formed in the leading edge of the locking bar to guide the locking pins into the channels. When sufficient force is applied, springs 38 will compress and the locking bar will move upward thereby permitting the locking pins to slide into channels 40 and engage indentations 42. Once the locking pins are in place within the indentations, the locking bar will be forced by springs 38 into locking position adjacent frame member 100.

Figure 9:
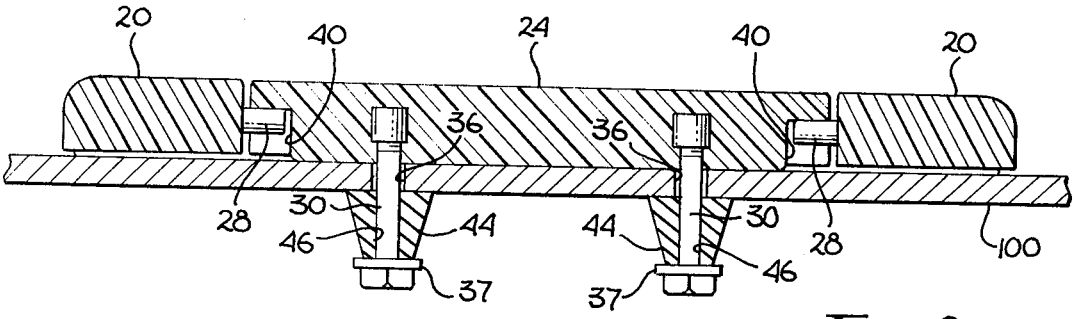
FIG. 9 is a cross-sectional end view of the invention taken substantially through section line 5—5 of FIG. 1 showing an alternative locking bar mounting scheme.

FIG. 9 shows a variation of the means for securing the locking bar 24 to the frame member 100. The means includes a pair of frustroconically-shaped resilient spacers 44 used in place of springs 38. The spacers 44, which are made of resilient material such as rubber, are each provided with a bore 46. Bolts 30 extend upwardly through bores 46 and openings 36 in frame member 100 into threaded engagement with locking bar 24. The resilient members are normally slightly compressed between washers 37 and the lower surface of frame member 100 so that locking bar 24 is firmly secured in place. Cover 20 is removed and replaced in the same manner as described previously regarding the securing means utilizing springs 38. For example, removal is accomplished by pulling cover 20 away from the locking bar thereby causing an upwardly directed force to be exerted on the bar. When the force is in the range of approximately 25 to 30 pounds, the resilient members 44 will become compressed to a sufficient degree to permit the locking pins 28 to slip out of indentations 42 in channels 40.

Cover 20 is preferably further secured in place by means of fabric fastening strips 48 and 50 made of synthetic materials which adhere when pressed together and which are commonly sold under the trademark Velcro. As can be seen in FIG. 1, an approximately 1 inch by 12 inch strip of Velcro-type material 48 is mounted on the bottom surface of the cover 20, using screws or the like, along the length of the edge opposite the locking pins 28. A second strip 50 of Velcro material, complementary to strip 48, is mounted on the surface of frame member 100 immediately below strip 48. When the cover 20 is closed, the hook-like and loop-like elements of strips 48 and 50 engage thereby latching the cover in place. Cover 20 can be unlatched by simply grasping the edge of the cover adjacent strip 48 and pulling upwardly with a force of approximately 20 to 35 pounds thereby causing strips 48 and 50 to separate.

A rubber seal 58 is also secured to the lower surface of cover 20. The seal 58 is seated in a channel 60 formed in the cover which extends around the complete periphery of the cover. When the cover 20 is closed, the rubber seal engages the upper surface of frame member 100 thereby effecting the desired seal.

A circular-shaped opening 52 is formed in the central region of cover 20 for receiving a toilet bowl 54. Bowl 54, which is preferably fabricated from stainless steel, is provided with a waste outlet 56 which is in communication with the interior of holding tank 22. A conventional toilet seat 62 is positioned over the toilet bowl 54 and hingedly coupled to the cover 20 by way of hinge 66. Similarly, a convention toilet seat cover 64 is attached to the cover 20 by way of hinge 66.

The recirculating toilet further includes a manually operated pump 68 used for flushing. Pump 68 is preferably a conventional diaphram pump although other types of manually operated pumps would also be suitable. Pump 68 is attached to the under side of cover 20 by four bolts 74 which extend upwardly through cover 20. An elongated opening 72 is formed in cover 20 to accept the pump operating handle 70.

The toilet is further provided with a flushing fluid pickup filter 80 which rests on the bottom of the waste holding tank 22 but is not attached thereto. The filter 80 is a drum-shaped hollow member having a plurality of small perforations which permit the flushing fluid, namely, a conventional liquid toilet chemical treatment and the liquid waste matter, to enter the filter while excluding the solid waste matter. The filter is preferably made of steel and plated with cadmium to provide corrosion resistance. A pick-up tube 82 is attached to the filter 80 which extends through the center region of the top of the filter into the interior. A flexible hose 86 is provided having one end attached to tube 82 and the other end attached to the inlet 78 of pump 68.

A flushing fluid outlet 88 is located in the upper portion of toilet bowl 54. Outlet 88 is arranged so that the flushing fluid will enter the bowl 54 tangential to the wall of the bowl thereby providing a swirling flow of fluid. A length of flexible hose 90 is coupled to an outlet 76 of pump 68 and to the flushing bowl outlet. Flushing is accomplished by reciprocating handle 70 thereby causing flushing fluid to be drawn up through filter 80, into hose 86 and finally to the toilet bowl 54 by way of hose 90.

Figure 3:
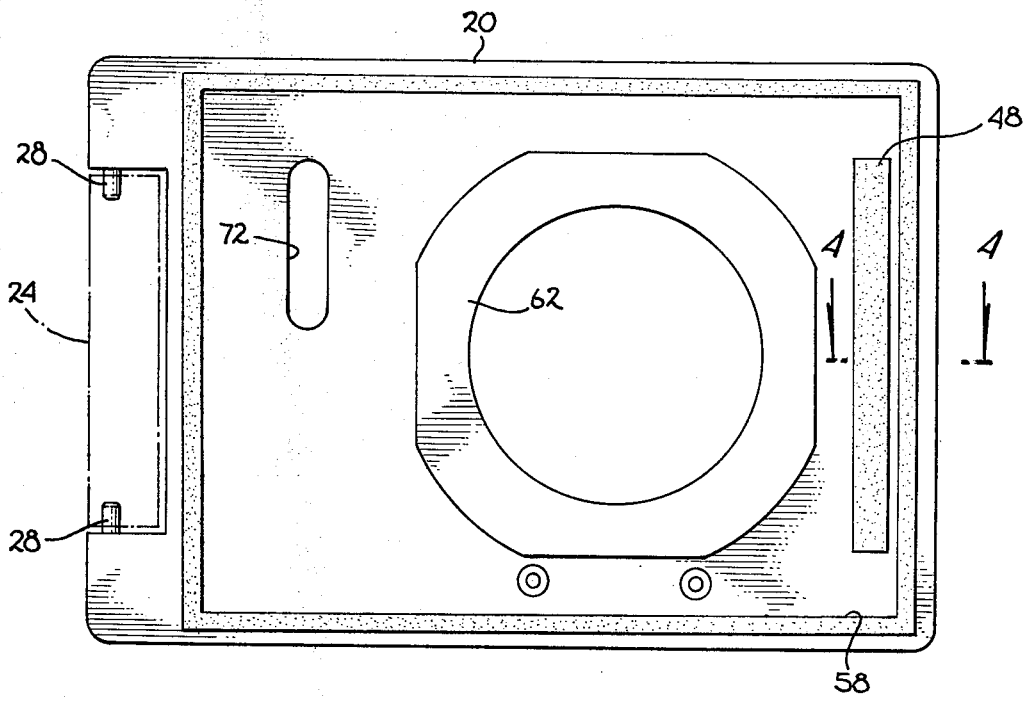
FIG. 3 is a bottom view of a second embodiment of the invention.
Figure 4:
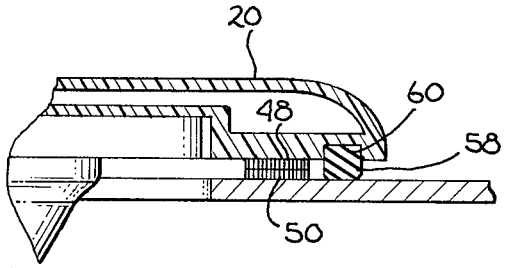
FIG. 4 is a fragmentary cross-sectional view of the invention taken substantially through section line 4—4 of FIG. 3.
Figure 10:
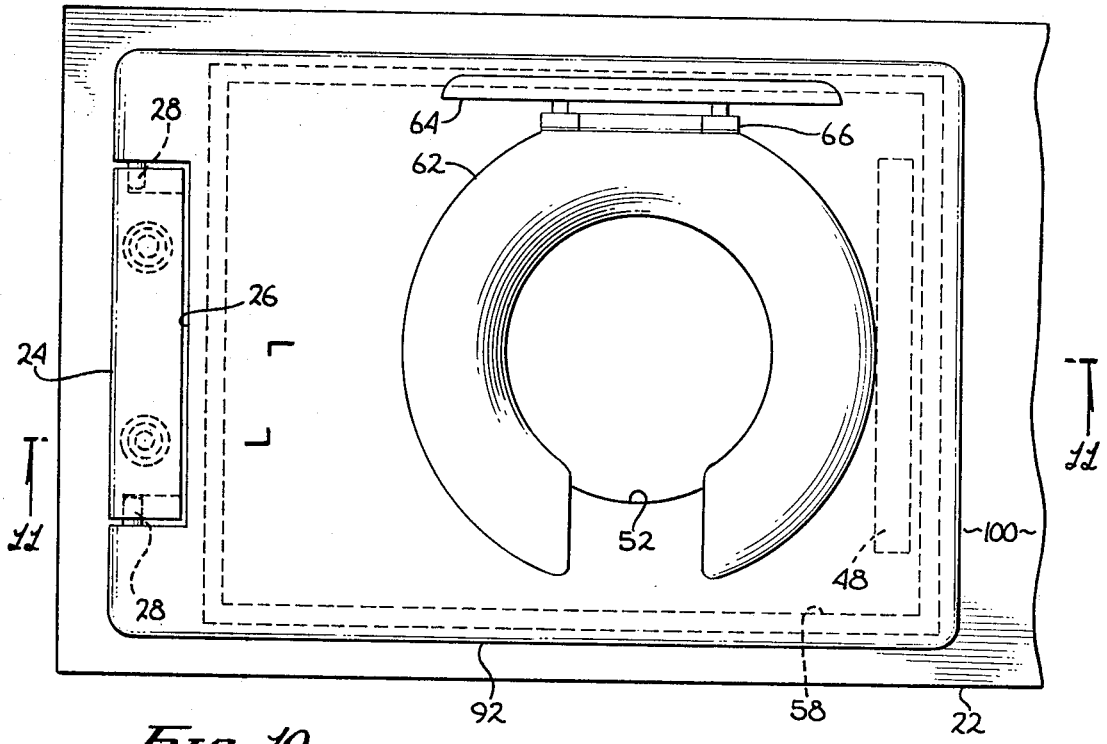
FIG. 10 is a partial plan view of a second embodiment of the invention.
Figure 11:
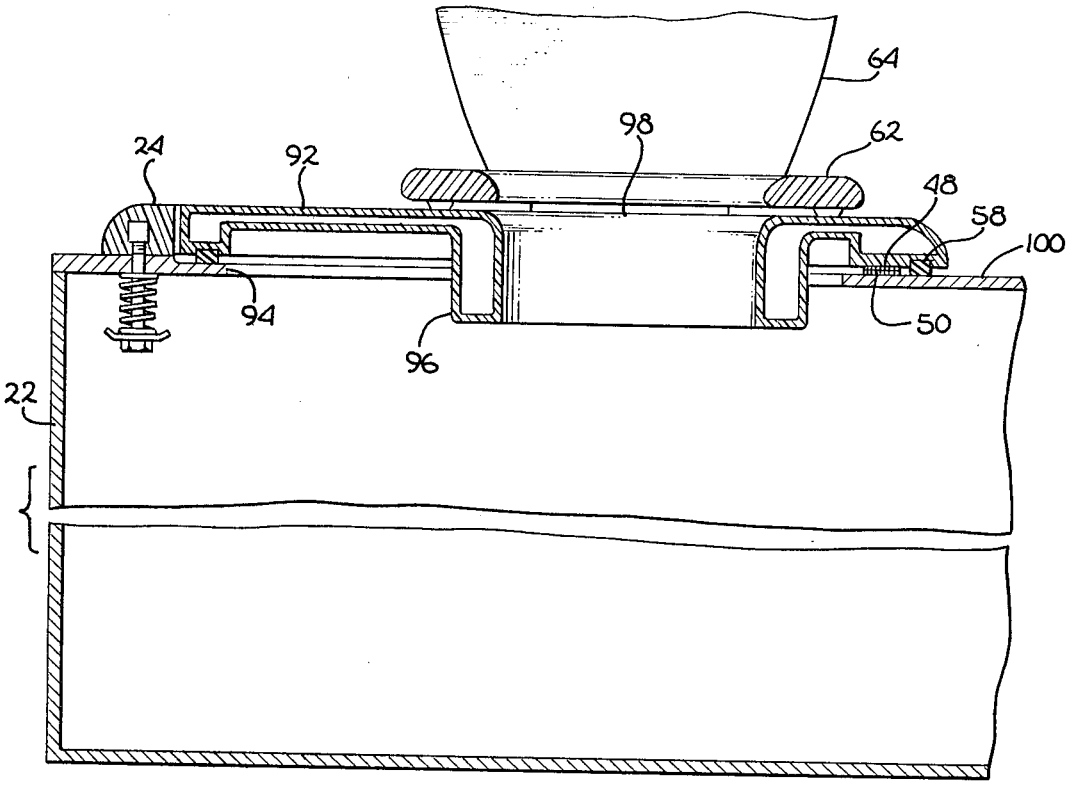
FIG. 11 is a cross-sectional view of the invention taken substantially through section line 11—11 of FIG. 10.

A second embodiment of the subject invention is shown in FIGS. 3, 10 and 11. The second embodiment toilet is a non-flushing toilet which includes substantially the same components as the first embodiment's toilet minus the toilet bowl 54, pump 68 and associated hardware. The non-flushing toilet is provided with a locking bar 24 which is identical to the bar of the flushing toilet and is permanently attached to frame member 100 in the same manner as previously described. The toilet further includes a removeable cover 92, similar to cover 20 of the flushable toilet, which has a slot 26 and locking pins 28 for engaging the locking bar 24. A rubber seal 58 is disposed on the lower surface around the periphery of the cover 92 for effecting a seal with the top surface at frame member 100. A cover latch comprised of two strips 48 and 50 of a Velcro-type material, identical to the latch of the flushable toilet, is attached to the cover 92 and the top surface of frame member 100.

The cover 92 further includes a circular opening 98 located in the central region of the cover with a downwardly extending collar 96 formed around the periphery of the opening. A toilet seat 62 and a seat cover 64 are positioned over the opening 98 and attached to cover 92 by way of hinge 66.

It can be seen that the novel toilet disclosed herein can readily be converted from a nonflushing toilet to a recirculating flushing toilet and vice-versa. If a flushing toilet is desired, the nonflushing toilet cover 92 is unlatched and decoupled from locking bar 24. A flushing toilet cover 20 having the pump 68 and associated filter 80 mounted thereon can then be installed onto frame member 100 as an integral unit by coupling the locking pins 28 to the compatable locking bar 24. Filter 80 can then be lowered into the holding tank 22 by way of flexible hose 86. The cover 20 can then be secured to the holding tank by way of latching strips 48 and 50. The process is, of course, reversed should one desire to change a flushable toilet to a nonflushable toilet. It is important to note that the waste holding tank 22 need not be pumped out in order to perform the conversion.

It should also be noted that a pre-existing conventional toilet could be readily converted to a quick change system. In this case, the conventional toilet seat and the toilet seat cover are removed from the conventional toilet leaving the waste holding tank such as tank 22 and the upper frame such as frame member 100. The locking bar 100 is then appropriately attached to the frame member as is the strip 50 of Velcro-type material thereby completing the conversion process. A flushing toilet cover or nonflushing cover 20 may then be attached to the locking bar 100 as previously described, as desired.

I claim:

1. A convertible toilet comprising:

a waste holding tank;

a frame member disposed over said waste holding tank;

a toilet cover, said toilet cover having an opening therethrough; and fastening means on said frame member and on said toilet cover, said fastening means being a means for manually fastening said cover to said frame member when a first force is applied to said cover in a first direction and manually unfastening said cover from said frame member when a second force is applied to said cover in a second direction;

said fastening means comprising:

a locking bar on said frame member;

a slot in an edge of said cover for receiving said locking bar;

a pair of opposing locking pins on said cover projecting into said slot;

said locking bar defining a pair of channels for receiving said locking pins and an indentation in a surface of each channel for mating with said locking pins; and a resilient coupling means on said locking bar and on said frame member for coupling said locking bar to said frame member with said resilient coupling means biasing said locking bar to a locking position while permitting said locking bar to be displaced from said locking position when a force is applied to said locking bar;

said resilient coupling means comprising:

at least one boss attached to said locking bar which extends downwardly through an opening in said frame member;

a stop member on said boss below said frame member; and a resilient member disposed between said frame member and said stop member;

and wherein said toilet further comprises:

a seal mounted on the lower surface of said toilet cover and extending around the periphery of said cover;

a first fastening strip mounted on the lower surface of said cover; and a second fastening strip mounted on the upper surface of said frame member adjacent said first fastening strip;

whereby when said cover is closed, said first and second fastening strips engage, thereby latching said cover in place, and whereby said seal engages the surface of said frame member.

2. The toilet of claim 1 wherein said boss is a bolt anchored to said locking bar and said stop member is a bolt head on said bolt.

3. The toilet of claim 2 wherein said resilient member is a spring.

4. The toilet of claim 2 wherein said resilient member is made of rubber.

5. The toilet of claim 1 wherein said toilet further includes a toilet seat and a seat cover both of which are hingedly coupled to said toilet cover.

6. The toilet of claim 1 further comprising:

a toilet bowl disposed in said toilet cover opening, said toilet bowl having a flushing fluid outlet;

a manually operated pump having a pump outlet and a pump inlet with said pump outlet coupled to said toilet bowl flushing fluid outlet; and a flushing fluid supply means for supplying flushing fluid to said pump inlet.

7. The toilet of claim 6 wherein said flushing fluid supply means is a fluid pick-up filter disposed in said waste holding tank coupled to said pump inlet by way of a flexible hose.

8. A convertible toilet comprising:

a waste holding tank;

a frame member disposed over said waste holding tank;

a toilet cover, said toilet cover having an opening therethrough;

a toilet bowl disposed in said toilet cover opening, said toilet bowl having a flushing fluid outlet;

a manually operated pump having a pump outlet and a pump inlet with said pump outlet coupled to said toilet bowl flushing fluid outlet;

a flushing fluid supply means for supplying flushing fluid to said pump inlet;

a locking bar on said frame member;

a slot in an edge of said cover for receiving said locking bar;

a pair of opposing locking pins on said cover projecting into said slot;

said locking bar defining a pair of channels for receiving said locking pins and an indentation in a surface of each channel for mating with said locking pins; and a resilient coupling means on said locking bar and on said frame member for coupling said locking bar to said frame member with said resilient coupling means biasing said locking bar to a locking position while permitting said locking bar to be displaced from said locking position when a force is applied to said locking bar;

said resilient coupling means comprising:

at least one boss attached to said locking bar which extends downwardly through an opening in said frame member;

a stop member on said boss below said frame member;

a resilient member disposed between said frame member and said stop member;

and wherein said toilet further comprises:

a seal mounted on the lower surface of said toilet cover and extending around the periphery of said cover;

a first fastening strip mounted on the lower surface of said cover; and a second fastening strip mounted on the upper surface of said frame member adjacent said first fastening strip;

whereby when said cover is closed, said first and second fastening strips engage, thereby latching said cover in place, and whereby said seal engages the surface of said frame member.

* * * * *